US005846061A

United States Patent [19]

Ledebuhr et al.

[11] Patent Number: 5,846,061

[45] Date of Patent: Dec. 8, 1998

[54] PERISTALTIC METERING PUMP

[75] Inventors: Richard L. Ledebuhr, Haslett; Gary R. Van Ee, Williamston, both of Mich.

[73] Assignee: Board of Trustees of Michigan State University, E. Lansing, Mich.

[21] Appl. No.: 746,446

[22] Filed: Nov. 8, 1996

[51] Int. Cl.[6] ..... F04B 43/08

[52] U.S. Cl. ..... 417/477.9; 417/475; 417/477.1; 417/477.3; 384/473

[58] Field of Search ..... 417/475, 477.1, 417/477.3, 477.6, 477.9; 384/473, 484, 127

[56] References Cited

U.S. PATENT DOCUMENTS

| | | | |
|---|---|---|---|
| 453,277 | 6/1891 | Nickerson et al. | 417/477.1 |
| 3,489,525 | 1/1970 | Natelson . | |
| 3,723,030 | 3/1973 | Gelfand | 417/475 |
| 3,740,173 | 6/1973 | Natelson . | |
| 3,791,777 | 2/1974 | Papoff et al. . | |
| 4,012,176 | 3/1977 | Drori . | |
| 4,179,249 | 12/1979 | Guttmann . | |
| 4,211,519 | 7/1980 | Hogan . | |
| 4,228,930 | 10/1980 | Hogan . | |
| 4,231,725 | 11/1980 | Hogan . | |
| 4,233,001 | 11/1980 | Schmid . | |
| 4,315,718 | 2/1982 | Hogan . | |
| 4,513,885 | 4/1985 | Hogan . | |
| 4,527,323 | 7/1985 | Dawson . | |
| 4,552,516 | 11/1985 | Stanley . | |
| 4,715,786 | 12/1987 | Wolff et al. . | |
| 4,768,713 | 9/1988 | Roper . | |
| 4,834,630 | 5/1989 | Godwin | 417/475 |
| 4,886,431 | 12/1989 | Soderquist et al. . | |
| 4,910,682 | 3/1990 | Wolff et al. . | |
| 4,976,590 | 12/1990 | Baldwin . | |
| 5,082,429 | 1/1992 | Soderquist et al. . | |
| 5,257,917 | 11/1993 | Minarik et al. | 417/475 |
| 5,318,413 | 6/1994 | Bertoncini . | |
| 5,342,182 | 8/1994 | Montoya et al. | 417/477.1 |
| 5,380,173 | 1/1995 | Hellstrom . | |
| 5,468,129 | 11/1995 | Sundén et al. . | |
| 5,482,447 | 1/1996 | Sundén et al. . | |

OTHER PUBLICATIONS

Product brochure entitled "Gorman–Rupp Industries—Pumps and Valves," Gorman–Rupp Industries, Dec. 1983.

Product brochure entitled "CDS Squeeze & Injection Pumps," CDS Ag Industries, Inc., 1988.

Instruction manual entitled "Loading the Tubing in the Masterflex® High–Capacity Pump Head," Barnant Company, 1984.

Product brochure entitled "The Randolph Pump," Randolph Austin Company, date unknown.

*Primary Examiner*—Charles G. Freay

*Attorney, Agent, or Firm*—Van Dyke, Gardner, Linn & Burkhart, LLP

[57] ABSTRACT

A multiple channel peristaltic metering pump includes a base having a pair of spaced apart bearings, a rotor supported on the base and an occlusion member. The rotor includes a rotation shaft in the bearings and a plurality of rollers mounted thereon. A pair of occlusion rings, which are located concentrically with the rotation shaft by the bearings, position the occlusion member with respect to the rollers. Each of the rollers is rotated about a bearing which is located in an opening having sufficient size to allow expansion of lubricant under high operating temperatures. A hose expansion space adjacent the rotor takes up any elongation of the hoses in order to avoid crimping. Hose spacers in the expansion space prevent hose creep along the rotor.

34 Claims, 6 Drawing Sheets

PERISTALTIC METERING PUMP

BACKGROUND OF THE INVENTION

This invention relates generally to peristaltic pumps and, more specifically, to peristaltic pumps having multiple pumping channels.

Peristaltic pumps are fluid-metering devices that are capable of pumping a wide variety of fluids at an accurate rate with good repeatability. Corrosives, abrasives, aggressive solvents, foodstuffs, and pharmaceuticals can be pumped without risk of contamination or deterioration of either the pump or the fluid being pumped because the only wetted part is the inside surface of the hose. The prior art includes several multiple channel peristaltic pump designs that have been used in various laboratory and industrial uses. Another area where peristaltic pumps have been used is in the application of crop protection materials and fertilizers for agriculture. With the increase of precise chemical use in agriculture, there is a need for rugged, dependable devices that are capable of providing accurate, repeatable metering characteristics, such as those generally provided by peristaltic pumps. However, the prior art has failed to provide satisfactory performance in the aggressive field environments encountered by agricultural users.

Corrosion, degradation, and abrasion of pump components, as a result of contact with environmental contaminants, are problems with known prior art devices. The results of this contamination are reduced hose life, decreased pump accuracy, and premature bearing failure, resulting in a failure of the pump. Another problem in the present art is a lack of repeatability and uniformity between pumping channels. In so-called "cartridge style" pumps, as described in U.S. Pat. No. 4,886,431, each hose is occluded independently by using a floating or adjustable occlusion surface. This allows the user to "fine-tune" occlusion on each hose to adjust the flow rate. This is not a desirable characteristic in field situations where a reasonably accurate flow needs to be reproduced after each disassembly without having to recalibrate every pump channel. The second example is in pumps similar to those described in U.S. Pat. No. 3,358,609 in which each channel has a separate non-adjustable occlusion surface. When these pumps are stacked together to create a multiple channel pump, it is difficult to achieve uniformity of flow between each channel because of differences in the individual occlusion surfaces.

Stacked or cartridge style multiple channel peristaltic pumps, such as those described above, require each occlusion surface to be disassembled to replace the encased hose. It would be desirable to have a simplified design where a minimal amount of disassembly is required to access and change hoses, and occlusion clearances remain consistent and fixed, thereby preserving accuracy, after each reassembly. This ease of serviceability is important to aggressive environment users who change hoses on regular service intervals to minimize the possibility of hose failure.

Prior art peristaltic pumps, both multiple channel and single channel, clamp flexible hosing at the input and output of the pump or pumping channel. As the hose wears or if there are incompatibilities between fluid and hose, the hose can undergo permanent physical expansion. If the hose is not adjusted to remove this expansion, the limited space in the pump housing can cause the hose to bind and pinch, reducing the accuracy of the pump and causing premature hose failure. It would be desirable to have a peristaltic pump that is able to accommodate this expansion without compromising the accuracy or reliability of the peristaltic pump.

SUMMARY OF THE INVENTION

The present invention provides a multiple channel peristaltic metering pump that is exceptionally accurate, repeatable, and uniform in flow between channels, and is adapted for corrosive or abrasive environments, such as those experienced in agricultural use. A multiple channel peristaltic metering pump, according to the invention, providing for exceptional ease in replacement of hoses, to the extent that field replacement of hoses is possible without complete disassembly of the pump, minimizes exposure of the worker to the metered fluid. Furthermore, the present invention provides for consistent, precise occlusion across all pumping channels by eliminating irregularities in occlusion between pumping channels.

A peristaltic pump, according to an aspect of the invention, has a base including a pair of spaced apart bearings and a rotor supported on the base. The rotor includes a rotating drive shaft in the bearings and a plurality of rollers mounted thereon. An occlusion member spaced from the rotor by an occlusion ring maintains a consistent separation distance between an occlusion surface of the occlusion member and the rollers. The occlusion ring is located concentrically with the rotation shaft by the bearings. Because the occlusion member locates the occlusion surface concentrically with the shaft, increased accuracy in the occlusion is achieved and maintained over the lifetime of the pump and is equal across all channels.

A peristaltic pump, according to another aspect of the invention, has a base including a pair of spaced apart bearings, an occlusion member including an occlusion surface and a rotor supported on the base for occluding hoses against the occlusion surface. The rotor includes a rotating drive shaft in the bearings, at least two hubs mounted to the shaft, and a plurality of rollers mounted between the hubs. Each of the rollers includes a tubular member defining an opening in each end thereof and a bearing in each of the openings which receives a pin extending from one of the hubs. The opening has a sufficient volume to contain a sufficient amount of lubricant for the associated bearing and an expansion space to accommodate expansion of the lubricant under high-operating temperatures. Preferably, each of the rollers also includes a seal against outside contaminants and loss of lubricant. The provision of an expansion space with each of the bearings of the rollers allows the bearing lubricant to expand and contract under the wide thermal cycles experienced by the bearings of the rollers due to the very high rotational speed of the rollers in combination with high ambient temperatures. By allowing the heated lubricant to expand into the expansion space, the lubricant remains in contact with the bearing rather than being forced out of the bearing. Preferably, each of the tubular members is defined by a hollow cylinder. The interior of the hollow cylinder defines both of the openings at the opposite end of that roller. This provides plenty of expansion space for the lubricant under high temperatures by creating a pillow of air to reduce pressure on the seal.

A peristaltic pump, according to another aspect of the invention, has a base including a pair of spaced apart bearings, a rotor supported on the base, and an occlusion member. The rotor includes a rotation shaft in the bearings and a plurality of rollers mounted thereon. The occlusion member includes an occlusion surface spaced from the rollers. According to this aspect of the invention, the peristaltic pump further includes an expansion cavity in the base extending to the rotor and configured to accommodate expansion of the hoses. The expansion space takes up any elongation of the hoses due to aging, or due to incompatibility with the fluid being pumped, and avoids binding of the hoses as they are occluded between the rollers and the occlusion surface.

A peristaltic pump, according to yet another aspect of the invention, has a base, including a pair of spaced apart bearings, a rotor supported on the base and an occlusion member. The rotor includes a rotation shaft in the bearings and a plurality of rollers mounted thereon. The occlusion member includes an occlusion surface spaced from the rollers. According to this aspect of the invention, hose spacers are provided adjacent to the rotor between each of adjacent pairs of hoses. The hose spacers prevent axial creep of the hoses along the rotor. By preventing such axial creep, the accuracy of the pump is maintained by reducing inaccuracies resulting from creep distorting the occlusion of the hoses and the service life of the hoses is increased by minimizing hose-to-hose abrasion.

These and other objects, advantages and features of this invention will become apparent upon review of the following specification in conjunction with the drawings.

DESCRIPTION OF THE PREFERRED EMBODIMENT

Figure 1:
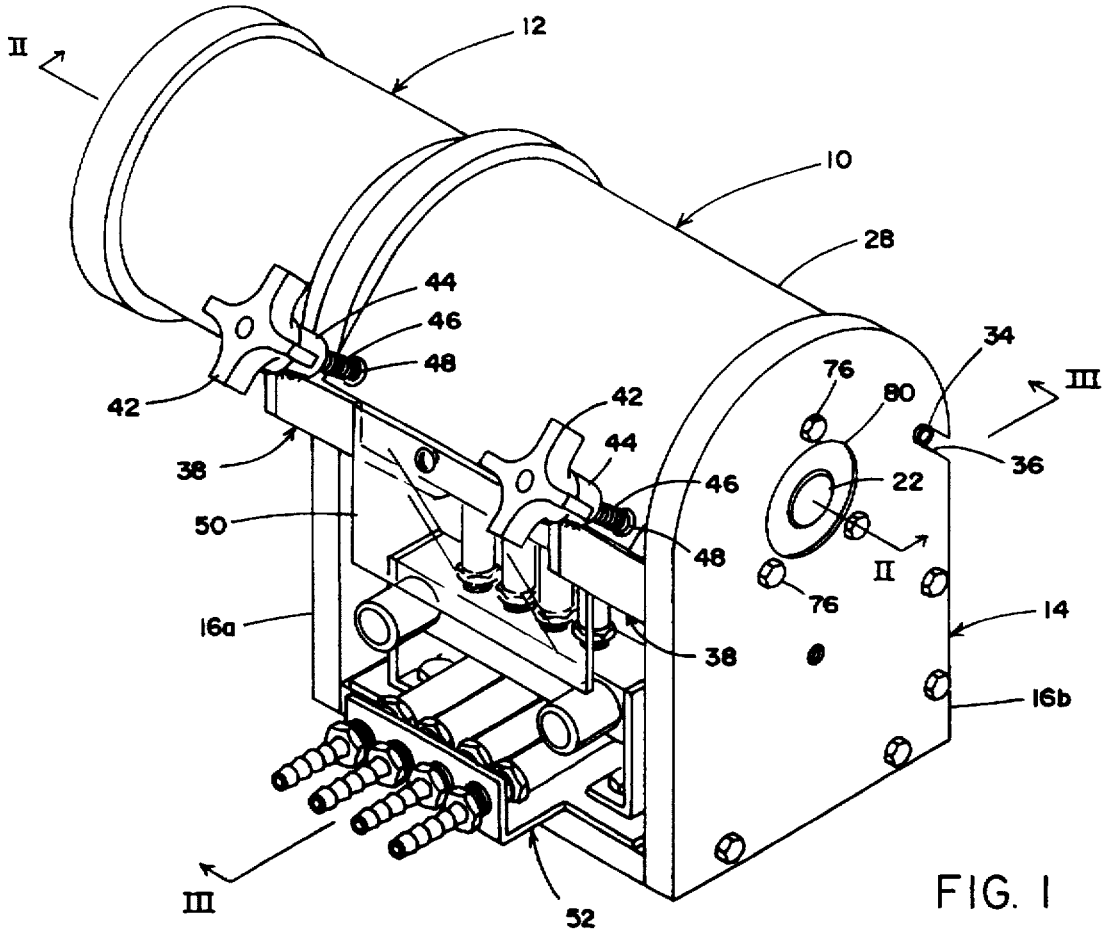
FIG. 1 is a perspective view of a multiple channel peristaltic metering pump according to the invention.
Figure 2:
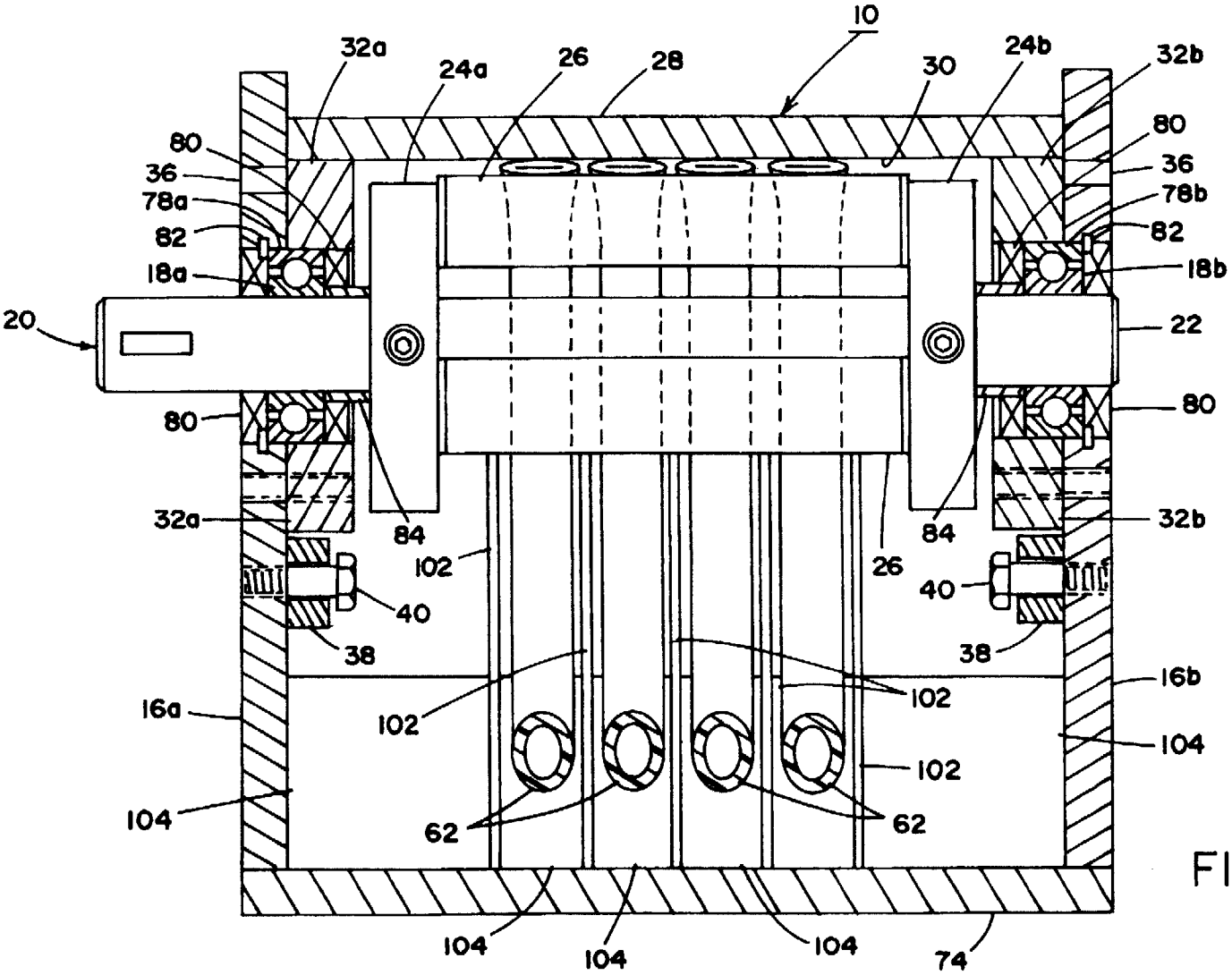
FIG. 2 is a sectional view taken along the lines II—II in FIG. 1.

. Referring now specifically to the drawings, and the illustrative embodiments depicted therein, a multiple channel peristaltic metering pump 10 is driven by an electric or a hydraulic motor 12 which forms no part of the invention (FIGS. 1 and 2). Multiple channel peristaltic metering pump 10 includes a housing 14 having sidewalls 16*a*, 16*b*, which support a pair of ball bearings 18*a*, 18*b*, which rotatably support a rotor assembly generally illustrated at 20. Roller assembly 20 is made up of a precision ground shaft 22 rotatably supported by bearings 18*a*, 18*b*, a pair of hubs 24*a*, 24*b* attached to shaft 22 and a plurality of rollers 26 which are rotatably supported between hubs 24*a*, 24*b*. Each bearing 18*a*, 18*b* is sealed by a seal 80 on opposite sides thereof and held in place by a clip 82 outwardly of the bearing and by a shaft spacer 84 inwardly of the bearing.

Multiple channel peristaltic metering pump 10 further includes an occlusion member, or stator, 28 which defines an occlusion surface 30 which is precisely spaced from rollers 26 by a pair of occlusion rings 32*a*, 32*b*. Each occlusion ring 32*a*, 32*b* is attached to the respective sidewall 16*a*, 16*b* by a plurality of fasteners 76 passing through openings in the respective sidewall and engaging tapped openings (not shown) in the respective occlusion ring. The openings in the sidewalls are oversized with respect to fasteners 76. Therefore, occlusion rings 32*a*, 32*b* float with respect to the sidewalls. Occlusion rings 32*a*, 32*b* are positioned with respect to the associated sidewalls 16*a*, 16*b* by the respective bearing 18*a*, 18*b*. As best seen by reference to FIG. 2, an outer race 78*a*, 78*b* of each bearing 18*a*, 18*b* is fitted within adjacent openings in the associated occlusion ring 32*a*, 32*b* and sidewall 16*a*, 16*b*. In this manner, the bearing locates the occlusion ring to be concentric with shaft 22. Accordingly, the occlusion distance between each roller 26 and occlusion surface 30 is precisely established because the rollers are also positioned about shaft 22. This allows occlusion member 28 to be removed for replacement of one or more hoses 62 and replaced while ensuring that the occlusion distance is kept constant. Furthermore, each time the pump is disassembled for refurbishing, the occlusion distance will be precisely set because bearings 18*a*, 18*b* will provide a location reference for the associated occlusion rings 32*a*, 32*b* in a manner that will be apparent to those skilled in the art.

Occlusion member 28 is removably mounted to housing 14 by a pair of pins 34 which extend from opposite lateral edges of the occlusion member and are received in slots 36 defined in sidewalls 16*a*, 16*b*. Slots 36 are elongated along an axis which is slightly less than tangential with occlusion rings 32*a*, 32*b*. A pair of clamps 38 are pivotally mounted by bolts 40, or other support shaft, which extend inwardly from sidewall 16*a*, 16*b*. Clamps 38 include hand-rotatable knobs 42, which are threadably received in sockets 44, in order to adjust the length of a threaded shaft 46 engaging detents 48 in occlusion member 28. Each threaded shaft is oriented along axes which intersect shaft 22. This places only axial loading on the clamps with substantially no lateral force. In this manner, by rotating knobs 42, clamps 38 can be disengaged from occlusion member 38 and pivoted out of the way, and occlusion member 28 can be entirely removed by removing pins 34 from slots 36. This allows complete access to the hoses for easy replacement thereof, as will be set forth in more detail below. When the clamps are reapplied, the force draws the pins 34 into slots 36 which draws occlusion member 28 positively into contact with occlusion rings 32*a*, 32*b* in order to space occlusion surface 30 a precise and uniform distance from rollers 26. Thus, the structure for removably positioning occlusion member 28 ensures concentricity between the drive shaft, roller path and the occlusion surface and ensures channel-to-channel uniformity and pump-to-pump repeatability. A guard 50 inhibits users' fingers from engagement with rotor assembly 20.

Figure 3:
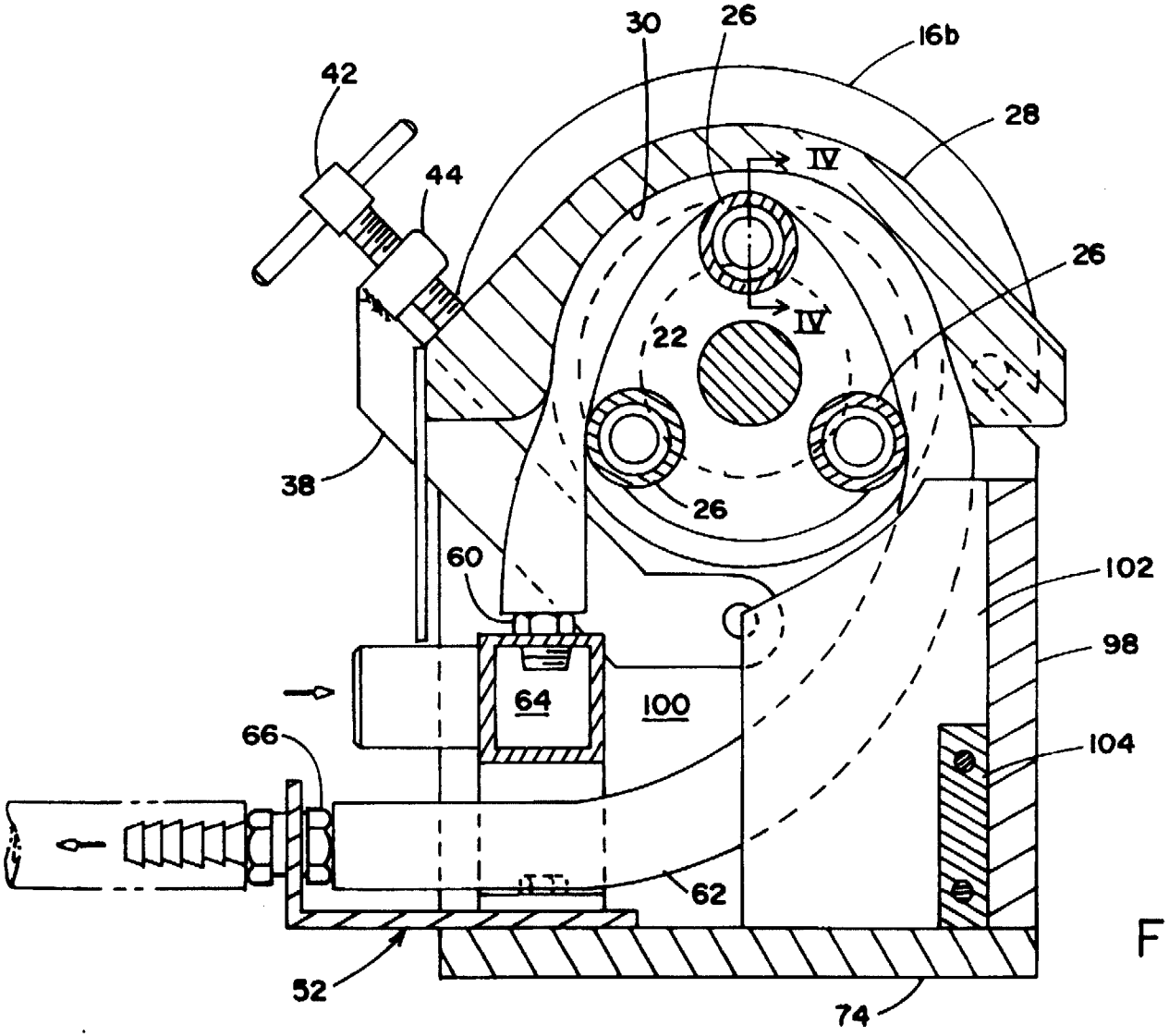
FIG. 3 is a sectional view taken along the lines III—III in FIG. 1.
Figure 6:
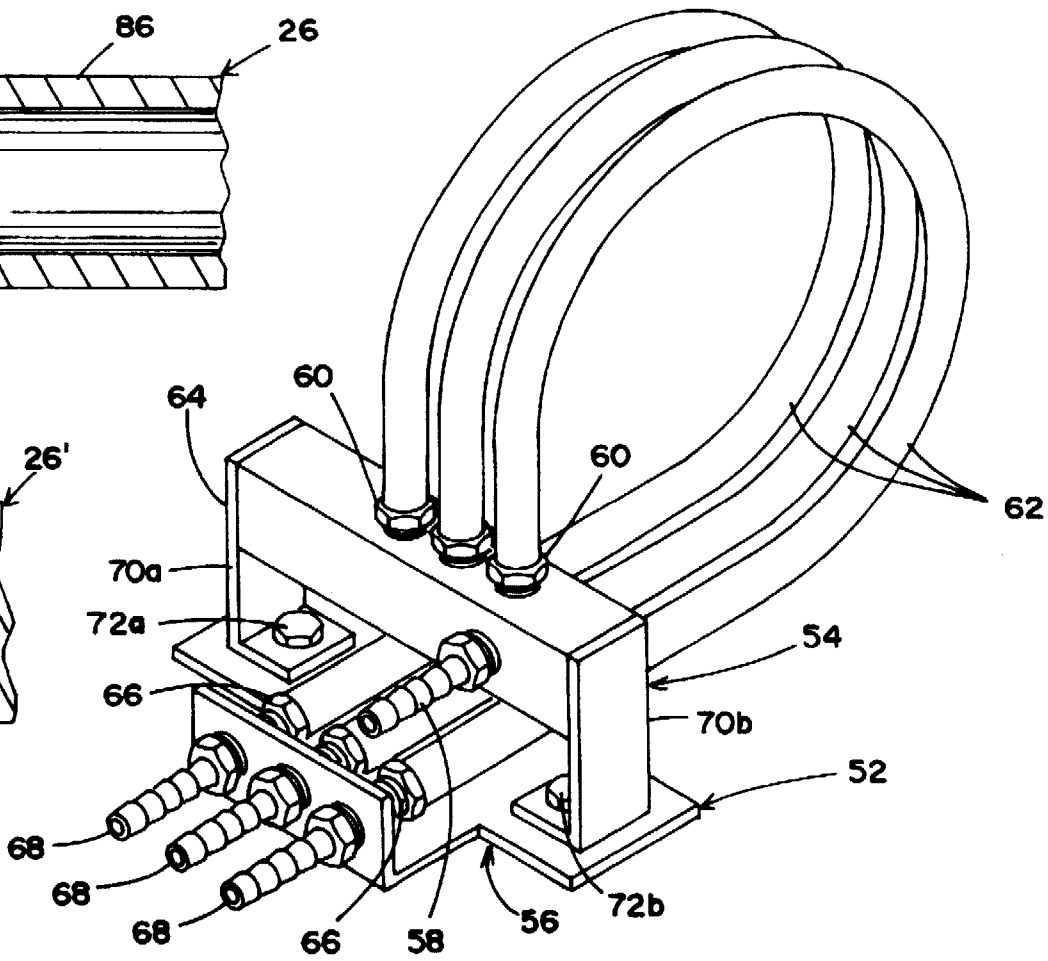
FIG. 6 is a perspective view of a manifold assembly.

Multiple channel peristaltic metering pump 10 further includes a manifold assembly 52 (FIGS. 3 and 6). Manifold assembly 52 includes an inlet manifold 54 and an outlet manifold 56. Inlet manifold 54 includes one or more inlet fittings 58 for connection with a source of fluid and plurality of hose fittings 60, each for connection with a hose 62 which is occluded between rollers 26 and occlusion surface 30. In the illustrated embodiment, inlet manifold 54 includes a common cavity 64 whereby fluid is distributed from a single inlet fitting 58 to each hose fitting 60. Alternatively, inlet manifold 54 could include a one-to-one relationship between each inlet fitting 58 and hose fitting 60. In the latter example, different fluids could be pumped through different hoses 62 or any combination of channel arrangements. Outlet manifold 56 includes a plurality of hose fittings 66, each for connection with an opposite end of a hose 62, and one or more outlet fittings 68 for connection with a spraying device, such as of the type disclosed in commonly assigned U.S. Pat. No. 4,659,013 issued to Richard L. Ledebuhr and Gary R. Van Ee for a SPRAY UNIT FOR CONTROLLED DROPLET ATOMIZATION, the disclosure of which is hereby incorporated herein by reference. In the illustrated embodiment, inlet manifold 54 is mounted by a pair of brackets 70*a*, 70*b* which include fasteners 72*a*, 72*b* which extend through openings (not shown) in outlet manifold 56 for fastening to a base 74 of housing 14. This configuration provides a modular design whereby either the inlet manifold or the outlet manifold can be readily removed and replaced with a manifold of a different configuration and reassembled with pump 10.

Figure 4:
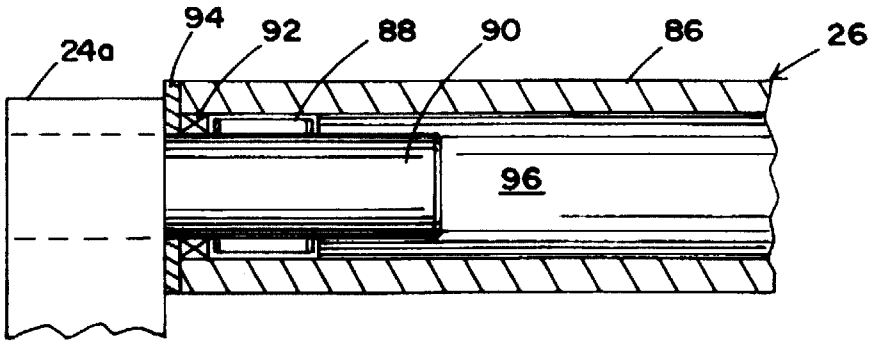
FIG. 4 is a sectional view taken along the lines IV—IV in FIG. 3.
Figure 5:
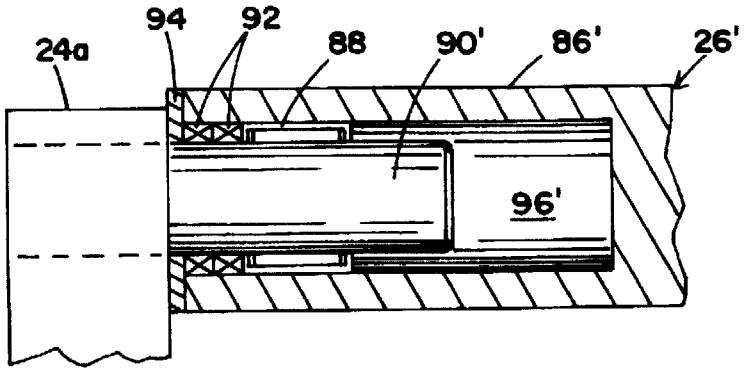
FIG. 5 is the same view as FIG. 4 of an alternative embodiment thereof.

Each roller 26 is made up of an elongated tubular member 86 having a needle bearing 88 journalled with a pin 90 affixed to a hub 24*a*, 24*b* (FIGS. 4–6). One or more seals 92 are positioned outwardly of bearing 88 in order to resist the escape of lubricant from the bearing. A sacrificial washer 94 accommodates rotation of each roller 26 without scoring the associated hub 24*a*, 24*b*. A cavity 96 is defined within tubular member 86 of sufficient size to accommodate a quantity of lubricant required to lubricate bearing 86 and including an expansion space to allow the lubricant to expand under elevated temperatures. In the embodiment illustrated in FIG. 4, cavity 96 is defined throughout the entire length of elongated member 86, which is accomplished by manufacturing each roller 26 from a hollow tubular member.

Alternatively, in the embodiment illustrated in FIG. 5, a tubular member 26' includes a solid bar having an enlarged cavity 96' which is of sufficient size to accommodate a quantity of lubricant for the bearing plus allowing for expansion of the lubricant under elevated temperatures. In the embodiment illustrated in FIG. 5, cavity 96' does not extend the entire length of the roller; the cavity is a minimum of approximately two and one-half (2½) inches in length.

Figure 8:
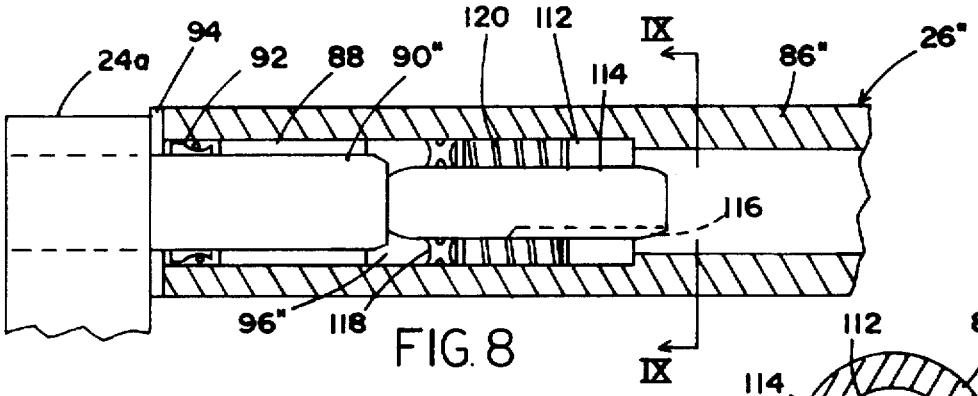
FIG. 8 is the same view as FIG. 4 of another alternative embodiment thereof.

Alternatively, in the embodiment illustrated in FIG. 8, a tubular member 26" includes a centering bushing 112 which is rigidly retained in an enlarged portion of cavity 96" of a tubular member 86". Centering bushing 112 rigidly mounts a stop pin 114 which abuts pin 90", which is rigidly mounted to hub 24*a*. Stop pin 114 has a venting groove 116 formed axially therein along at least a portion of its length and which extends on both sides of centering bushing 112. A ring seal 118 is biased away from centering bushing 112 by a spiral spring 120.

Figure 9:
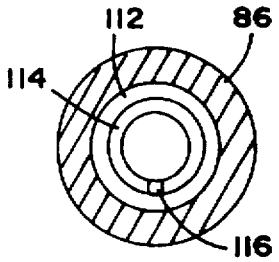
FIG. 9 is a sectional view taken along the lines IX—IX in FIG. 8.

The structure for roller 26" illustrated in FIGS. 8 and 9 is positively positioned with respect to hubs 24*a*, 24*b*. This is a result of contact between adjacent ends of pins 90", which are fixed to hubs 24*a*, 24*b*, and stop pins 114, which are fixed to tubular member 86" by centering bushing 112. This prevents axial movement of the roller, thus taking axial load off of sacrificial washer 94 in order to reduce wear on the sacrificial washer. An additional advantage of roller 26" is that the lubrication chamber 96" is pressurized by the action of spiral spring 120 against ring seal 118. The lubricant thereby keeps a pressure against seal 92 in order to prevent the entry of contaminants into chamber 96". Additionally, the volume of lubricant cavity 96" can expand and contract under the bias of spring 120 in order to accommodate wide temperature variations in the lubricant. This embodiment allows the pump to operate in any angular orientation without loss of lubricant to bearings 88.

In order to assemble roller 26", the components, with the exception of pin 90", are assembled to the roller and one end thereof is facing with its opening upwardly and filled with an appropriate quantity of lubricant. Pin 90" is then inserted through seal 92 and tubular member 86" is reoriented such that stop pin 114 is now facing upwardly. As the tubular member is further inserted over pin 90", the lubricant, and entrapped air, compresses spring 120 until ring seal 118 moves past venting groove 116. This exposes cavity 96" to the venting groove which vents any air and excess lubricant through venting groove 116. As the air and excess lubricant are removed from chamber 96", spring 120 repositions ring seal 118 away from groove 116, thus sealing chamber 96".

Housing 14 defines an expansion cavity 100 between sidewalls 16*a*, 16*b*, bottom wall 74 and a rear wall 98 of the housing (FIGS. 2 and 3). Cavity 100 extends from rotor assembly 20 and provides an expansion space to accommodate elongation of hoses 62. As can be seen by reference to FIG. 3, elongation of a hose, which is affixed at both ends by hose fittings 60, 66, is accommodated within housing 100 without kinking of the hose. Cavity 100 is divided into compartments by a plurality of spacers 102, each of which separates two adjacent hoses. Each spacer 102 is affixed to rear wall 98 by a mounting block 104. Spacers 102 prevent axial creepage along the rotor assembly 20 and, thereby, keep the occlusion of each hose 62 more constant. Advantageously, the unique combination of spacers 102 within cavity 100 accommodates the extension of the hoses while resisting axial creep of the hoses along the rotor. Additionally, because hoses 62 are attached at both ends to manifold assembly 52, rotor assembly 20 can be rotated in a reverse direction in order to purge the hoses as desired.

In the illustrated embodiment, the wall members of housing 46 and occlusion ring 32 are made from high-strength 6061 aluminum plate. Occlusion member, or stator, 28 is made from extruded 6061 aluminum. The aluminum members are surface-treated with hard-coat anodizing, including Teflon impregnation, such as Nituff coating marketed by Nimet Corp. in South Bend, Ind. Such treatment provides a Rockwell 70 surface hardness which is abrasion resistant and corrosion resistant while providing surface lubrication. Rollers 26 are made from one-inch OD stainless steel with a 0.2-inch wall thickness. Hoses 62 are selected to be appropriate to the application. One such hose is Norprene Model No. A60G tubing marketed by Norton Plastics. Spacers 102 and sacrificial washers 94 are made from UMHW material. Seals 92 and 80 are energized seals manufactured by Chicago Rawhide under Model No. 4909. Bearings 88 are full compliment needle bearings.

The present invention provides a precision multiple channel peristaltic metering pump which overcomes the difficulties of the prior art by providing precision metering in a rugged environment with a long useful life. Hose replacement is exceptionally easy and can be accomplished in the field without requiring return to the maintenance facility. The present invention finds maximum utility with a minimum of four and a maximum of approximately 13 hose channels. However, the pump could be used with fewer than four channels or greater than 13 channels for particular applications. Additionally, shim sleeves can be placed around rollers 26, 26' and 26" if it is desired to utilize hoses 62 having lesser wall thickness.

Figure 7:
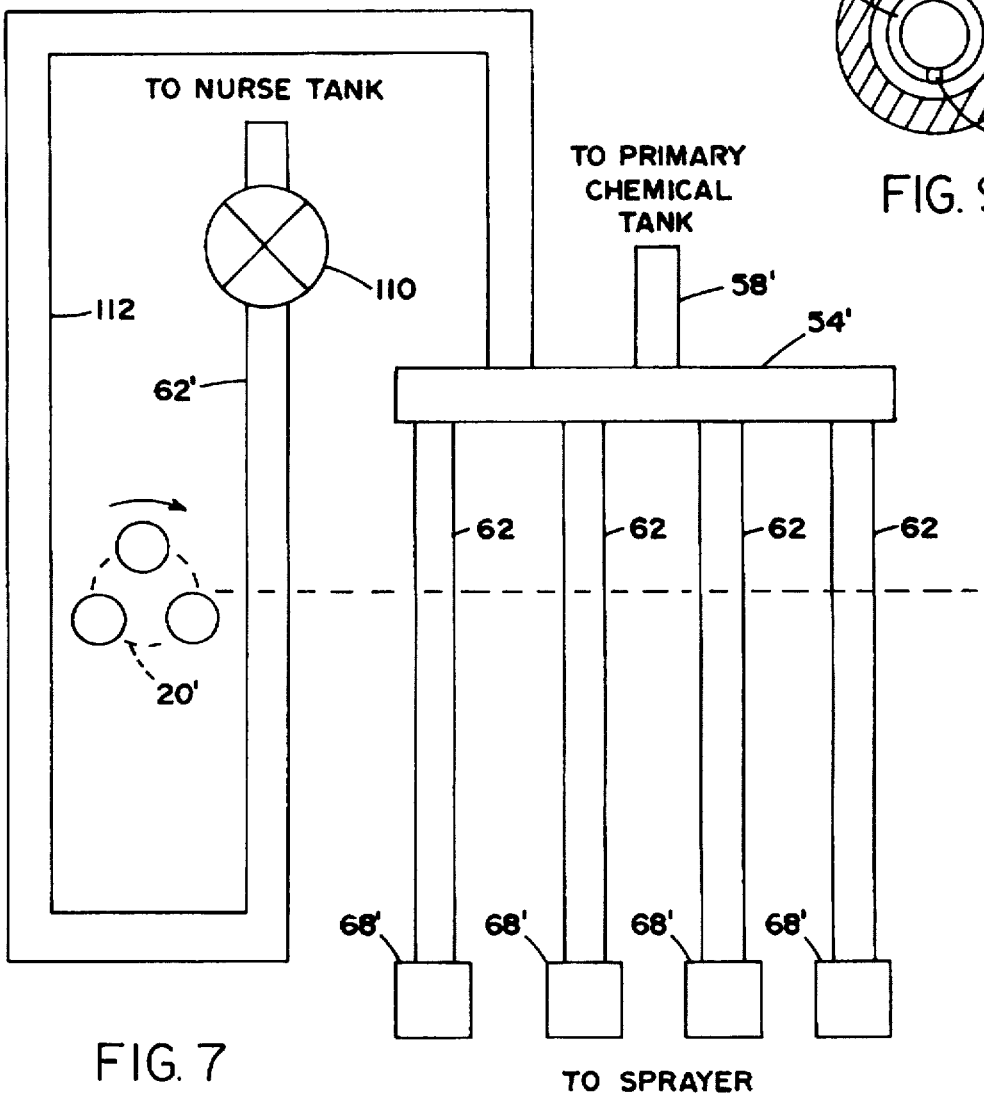
FIG. 7 is a schematic diagram of an application of the multiple channel peristaltic metering pump.

One application for a multiple channel peristaltic metering pump is illustrated in FIG. 7. A multiple channel peristaltic metering pump assembly 10' includes an inlet and outlet manifold 54' illustrated with four hoses (62) interconnecting the inlet manifold with a plurality of individual outlet fittings 68' and progressively occluded by rotor assembly 20'. An additional channel is defined by a hose 62' and an inlet valve 110. Hose 62' is also occluded by rotor assembly 20', and its outlet end illustrated at 112 is interconnected with inlet manifold 54'. This additional channel provides for selective precision addition of supplemental chemicals to the primary chemical. In one application, inlet fitting 58' is connected with a liquid fertilizer and inlet valve 110 is connected with a auxiliary tank containing a herbicide. The pump rotor assembly 20' is rotated in synchronism with ground speed by a ground speed control. With valve 110 closed, fertilizer is dispensed in a conventional manner. When the operator observes a patch of weeds, valve 110 is opened and a precise ratio of herbicide is added with the fertilizer. Other applications for metering pump assembly 10' will be readily apparent to those skilled in the art.

Changes and modifications in the specifically described embodiments can be carried out without departing from the principles of the invention. For example, shaft 22 may be bored at its drive end and formed with an internal key slot. This structure would allow a direct coupling of a motor shaft having a key fitted within the bore of the pump shaft. This arrangement allows the motor to be coupled to a force pad and the force pad coupled directly to the pump sidewall. This provides a sealed motor/pump interface to resist entry of corrosive chemicals to the pump bearings. Additionally, the opposite end of the pump drive shaft may extend outwardly of the pump housing and be keyed in order to provide a power takeoff to drive other pumps or other devices, such as speed sensors and the like. Additionally, although only two roller-mounting hubs are illustrated, additional hubs can be used especially in applications where it is desired to provide roller phasing in order to minimize pressure surges, as is well known in the art.

Figure 10:
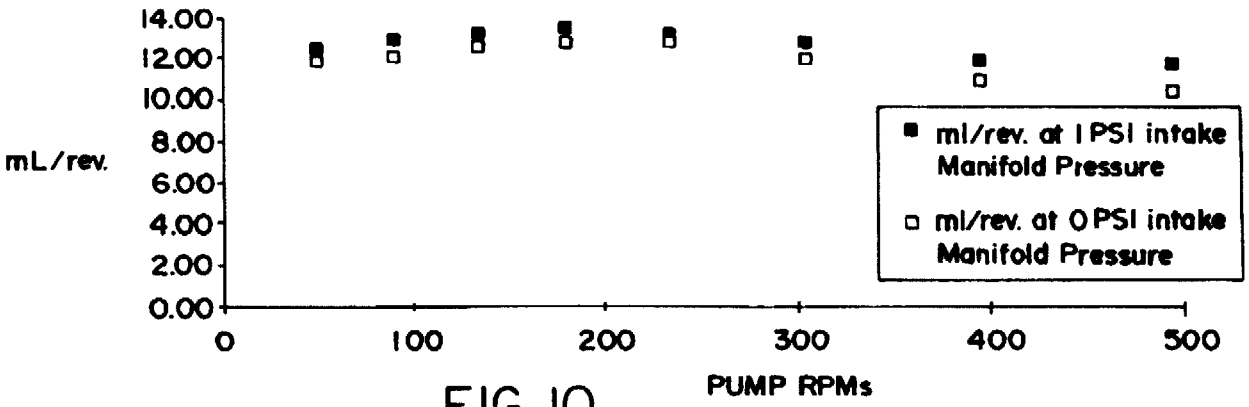
FIG. 10 is a graph illustrating fluid flow per revolution at various speeds of a multiple channel peristaltic metering pump according to the invention with 100 hours of wear on the hoses at two different intake manifold pressures.
Figure 11:
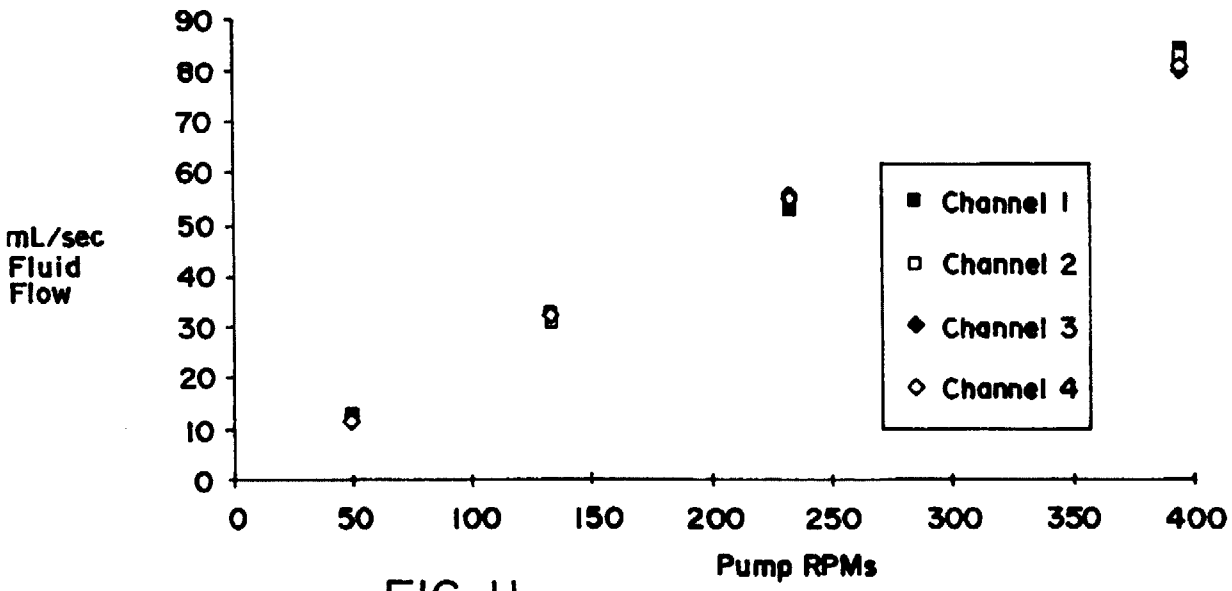
FIG. 11 is a graph illustrating fluid flow for each channel in a four-channel peristaltic metering pump according to the invention at various pump speeds.

An advantage of the multiple channel peristaltic pump, or metering pump, described herein is that it is capable of repeatable precision operation at any speed up to and including at least approximately 500 rpms. FIG. 10 illustrates the consistent output per revolution at various speeds and at various inlet pressures. Even though this data was taken with hoses having approximately 100 hours of use, the output is exceptionally constant. FIG. 11 illustrates the channel-to-channel comparison of the same pump at various operating speeds. It can be seen that uniform output is achieved from all channels across the range of operating speeds.

The protection provided to the invention is intended to be limited only by the scope of the appended claims, as interpreted according to the principles of patent law including the doctrine of equivalents.

The embodiments of the invention in which an exclusive property or privilege is claimed are defined as follows:

1. A multiple channel peristaltic pump, comprising:

a base including a pair of spaced apart bearings;

a rotor supported on said base, said rotor including a rotating drive shaft in said bearings and a plurality of rollers mounted thereon;

an occlusion member spaced from said rotor by at least two occlusion rings in order to maintain a consistent separation distance between an occlusion surface of said occlusion member and said rollers, said occlusion rings located concentrically with said rotation shaft by said bearings;

multiple hoses between said rotor and said occlusion surface;

wherein said occlusion member is removably supported on said base to accommodate replacement of hoses; and a pivot supporting one end of said occlusion member and at least one removable clamp supporting an opposite end of said occlusion member.

2. The peristaltic pump in claim 1 wherein said pivot is a plurality of pins on said occlusion member received in elongated slots on said base oriented generally radially with respect to said occlusion rings.

3. The peristaltic pump in claim 1 wherein said at least one removable clamp applies a force on said occlusion member along an axis extending generally through said drive shaft.

4. The peristaltic pump in claim 1 including an expansion cavity in said base extending to said rotor and configured to accommodate expansion of hoses.

5. The peristaltic pump in claim 1 wherein said occlusion rings are attached to said base in a manner which allows the occlusion rings to be adjustably positioned with respect to the base, that position being determined by the outside diameter of the bearing.

6. A multiple channel peristaltic pump, comprising:

a base including a pair of spaced apart bearings;

a rotor supported on said base, said rotor including a rotating drive shaft in said bearings and a plurality of rollers mounted thereon;

an occlusion member spaced from said rotor by at least two occlusion rings in order to maintain a consistent separation distance between an occlusion surface of said occlusion member and said rollers, said occlusion rings located concentrically with said rotation shaft by said bearings;

multiple hoses between said rotor and said occlusion surface;

an expansion cavity in said base extending to said rotor and configured to accommodate expansion of said hoses; and a manifold assembly including fittings for opposite ends of said hoses.

7. A multiple channel peristaltic pump, comprising:

a base including a pair of spaced apart bearings;

a rotor supported on said base, said rotor including a rotating drive shaft in said bearings and a plurality of rollers mounted thereon;

an occlusion member spaced from said rotor by at least two occlusion rings in order to maintain a consistent separation distance between an occlusion surface of said occlusion member and said rollers, said occlusion rings located concentrically with said rotation shaft by said bearings;

multiple hoses between said rotor and said occlusion surface;

an expansion cavity in said base extending to said rotor and configured to accommodate expansion of said hoses; and hose spacers in said cavity for preventing axial creep of said hoses along said rotor.

8. A multiple channel peristaltic pump, comprising:

a base including a pair of spaced apart bearings;

a rotor supported on said base, said rotor including a rotating drive shaft in said pair of bearings, at least two hubs mounted to said shaft and a plurality of rollers mounted between said hubs, wherein each of said rollers includes a tubular member defining an opening in each end thereof and a bearing in each said opening receiving a pin extending from one of said hubs, wherein each said opening has sufficient volume to contain a sufficient amount of lubricant for the associated bearing and an expansion space to accommodate expansion of the lubricant;

an occlusion member including an occlusion surface spaced from said rollers; and multiple hoses between said rotor and said occlusion surface.

9. The peristaltic pump in claim 8 wherein each of said tubular members is defined by hollow cylinder defining both openings at opposite ends of that roller.

10. The peristaltic pump in claim 8 including a sacrificial washer on each said pin between the associated one of said hubs and an end of one of said rollers.

11. The peristaltic pump in claim 8 including a stop attached within each said opening in order to engage said pin and prevent axial movement of the associated roller with respect to that pin.

12. The peristaltic pump in claim 11 including a pressurizing member straddling said stop in order to apply pressure to a lubricant in said opening.

13. The peristaltic pump in claim 12 including a vent defined in said stop that is controlled by the position of said pressuring member.

14. The peristaltic pump in claim 8 wherein said occlusion member spaced from said rotor by at least two occlusion rings in order to maintain a consistent separation distance between said occlusion surface of said occlusion member and said rollers, said occlusion rings located concentrically with said rotation shaft by said bearings.

15. The peristaltic pump in claim 14 wherein said occlusion member is removably supported on said base to accommodate replacement of said hoses.

16. The peristaltic pump in claim 8 including an expansion cavity in said base extending to said rotor and configured to accommodate expansion of said hoses.

17. The peristaltic pump in claim 16 including a manifold assembly including fittings for opposite ends of said hoses.

18. The peristaltic pump in claim 16 including hose spacers in said cavity for preventing axial creep of said hoses along said rotor.

19. A multiple channel peristaltic pump, comprising:

a base including at least one bearing;

a rotor supported on said base, said rotor including a rotation shaft in said at least one bearing and a plurality of rollers mounted thereon;

an occlusion member including an occlusion surface spaced from said rollers;

a plurality of hoses between said rollers and said occlusion member; and an expansion cavity in said base extending to said rotor wherein said hoses are constrained to form an angle sufficient to allow said hoses to bow in said expansion cavity and said expansion cavity is configured to accommodate expansion of hoses.

20. The peristaltic pump in claim 19 including a manifold assembly including fittings for opposite ends of said hoses.

21. The peristaltic pump in claim 19 including hose spacers in said cavity for preventing axial creep of said hoses along said rotor.

22. A multiple channel peristaltic pump, comprising:

a base including at least one bearing;

a rotor supported on said base, said rotor including a rotation shaft in said at least one bearing and a plurality of rollers mounted thereon;

an occlusion member including an occlusion surface spaced from said rollers;

a plurality of hoses between said rotor and said occlusion member; and hose spacers separate from said rotor and said occlusion member between adjacent pairs for preventing axial creep of hoses along the rotor.

23. A multiple channel peristaltic pump, comprising:

a base including a pair of spaced apart bearings;

a rotor supported on said base, said rotor including a rotation shaft in said bearings and a plurality of rollers mounted thereon;

an occlusion member including an occlusion surface spaced from said rollers;

a plurality of hoses between said rotor and said occlusion surface;

a primary inlet for connection with a primary liquid source and at least one hose defining a primary channel and an auxiliary inlet valve for connection with an auxiliary liquid source, at least one of said hoses connected between said inlet valve and said inlet manifold selectively mixing in constant proportion an auxiliary liquid with the primary liquid when the inlet valve is open.

24. The peristaltic pump in claim 23 wherein said primary inlet is configured to be connected with a liquid fertilizer tank.

25. The peristaltic pump in claim 23 wherein said auxiliary inlet valve is configured to be connected with a herbicide tank.

26. The peristaltic pump in claim 23 including a drive for said rotor which is synchronized with ground speed of a vehicle.

27. The peristaltic pump in claim 23 wherein said occlusion member is self-centering with respect to said rotor.

28. The peristaltic pump in claim 27 wherein said occlusion member and said base are joined at one portion by a pin on one of said occlusion member and said base in an angled slot on the other of said occlusion member and said base, and said occlusion member and said base are joined at an opposite portion by a clamp between said occlusion member and said base.

29. A multiple channel peristaltic pump, comprising:

a base including at least one bearing;

a rotor supported on said base, said rotor including a rotative drive shaft in said at least one bearing;

an occlusion member spaced from said rotor and defining an occlusion surface; and a plurality of hoses between said occlusion member and said rotor;

wherein said occlusion member and said base are joined at one portion by at least one pin on one of said occlusion member and said base in at least one slot on the other of said occlusion member and said base, and wherein said occlusion member and said base are joined at an opposite portion by at least one clamp between said occlusion member and said base, wherein said at least one slot is angled to draw said occlusion member toward said rotor so that said occlusion member is self-centering with respect to said rollers.

30. The peristaltic pump in claim 29 including at least one occlusion ring concentric with said drive shaft and configured to abut said occlusion surface of said occlusion member.

31. The peristaltic pump in claim 30 wherein said at least one occlusion ring is located concentrically with said rotation shaft by said at least one bearing.

32. A peristaltic pump in claim 29 wherein said at least one slot is slightly less than tangential with respect to said at least one occlusion ring.

33. A multiple channel peristaltic pump, comprising:

a base including at least one bearing;

a rotor supported on said base, said rotor including a rotation shaft in said at least one bearing and a plurality of rollers mounted thereon;

an occlusion member including an occlusion surface spaced from said rollers;

a plurality of hoses between said rotor and said occlusion member; and an inlet manifold including hose fittings for one end of said hoses and a plurality of inlet fittings for connection with a source of fluid.

34. The peristaltic pump in claim 33 including an outlet manifold having hose fittings for an opposite end of said hoses.

* * * * *